United States Patent [19]

Reeves

[11] Patent Number: 5,070,550

[45] Date of Patent: Dec. 10, 1991

[54] SHOWER CLOSURE

[76] Inventor: Eric W. Reeves, 11773 Hammack St., Culver City, Calif. 90230

[21] Appl. No.: 465,368

[22] Filed: Jan. 16, 1990

[51] Int. Cl.[5] ..... A47K 3/22

[52] U.S. Cl. ..... 4/608; 4/558; 4/610; 4/612

[58] Field of Search ..... 4/557–559, 4/571, 580, 584, 585, 596, 597, 599, 600, 605, 612, 607–610, 614; 52/63, 90; 135/106–108

[56] References Cited

U.S. PATENT DOCUMENTS

| | | | |
|---|---|---|---|
| 1,059,314 | 4/1913 | Petter | 4/597 X |
| 2,287,419 | 6/1942 | Duval | 4/608 |
| 2,641,770 | 6/1953 | Chapin | 4/597 |
| 2,725,576 | 12/1955 | Schwersinske | 4/609 |
| 2,771,896 | 11/1956 | Call | 135/107 |
| 2,776,439 | 1/1957 | Rondinelli | 4/608 X |
| 2,810,390 | 10/1957 | Wallace et al. | 135/106 |
| 2,928,403 | 3/1960 | Hoskins | 135/107 |
| 3,162,193 | 12/1964 | Zacks | 4/597 X |
| 3,613,127 | 10/1971 | Bond | 4/597 X |
| 3,713,585 | 1/1973 | Conklin | 4/597 X |
| 3,864,760 | 2/1975 | Bowen | 4/597 |
| 3,952,463 | 4/1976 | Lane | 52/63 |
| 3,995,330 | 12/1976 | Meyers | 4/605 |
| 3,996,987 | 12/1976 | Rodriguez | 4/608 X |
| 4,064,570 | 12/1977 | Kim | 4/600 |
| 4,127,905 | 12/1978 | Bowen | 4/612 X |
| 4,171,595 | 10/1979 | Tucker | 4/599 X |
| 4,327,961 | 5/1982 | Kladitis | 4/597 X |
| 4,333,187 | 6/1982 | Schuler | 4/608 |
| 4,365,368 | 12/1982 | Boggs | 4/596 |
| 4,769,862 | 9/1988 | Skrzelowski | 4/610 |
| 4,862,527 | 9/1989 | McAllister | 4/612 |

FOREIGN PATENT DOCUMENTS

| | | | |
|---|---|---|---|
| 0327041 | 8/1989 | European Pat. Off. | 4/597 |
| 2415906 | 10/1975 | Fed. Rep. of Germany | 4/612 |
| 2449119 | 4/1976 | Fed. Rep. of Germany | 4/612 |
| 3628691 | 3/1988 | Fed. Rep. of Germany | 4/607 |
| 2630902 | 11/1989 | France | 4/612 |

*Primary Examiner*—Henry J. Recla
*Assistant Examiner*—Casey Jacyna
*Attorney, Agent, or Firm*—Spensley Horn Jubas & Lubitz

[57] ABSTRACT

An improved closure for use in a space at the upper portion of a stall area for a bath, shower, spa or the like, to provide an humidity and heat barrier. A foldable thin sheet of material is supported by a framework mounted in the upper portion of the stall area. The framework is designed to be supported in the upper portion of the stall by urging against or securing to two opposing walls. A highly flexible material, such as a thin vinyl sheet or a fabric sheet, is chosen for the foldable sheet. The flexible sheet is supported by the framework in an inverted V-shaped arrangement.

26 Claims, 12 Drawing Sheets

SHOWER CLOSURE

BACKGROUND OF THE INVENTION

1. Field of the Invention

The present invention relates to an improved closure for a stall area of a shower, bath, spa, or the like, and more particularly, to an improved closure for use in a space at the upper portion of the stall area to provide a humidity and heat barrier.

2. Description of Related Art

Typically, a bathtub, shower, spa, or the like, is provided in a stall area which is covered by a ceiling, bounded on three sides by walls, and open on a fourth side to allow a user to enter or exit the tub, shower, spa, etc. Barrier devices for inhibiting the escape of moisture and heat from the stall area of a bathtub or a shower have taken a variety of forms. For example, a moisture and heat barrier is provided by a common shower curtain supported by a curtain rod along the length of the open side of the stall area. Some shower or bath facilities employ a sliding or hinged door structure as an alternative to a shower curtain. Such door structures also provide a moisture or heat barrier.

However, many facilities include a stall area which has a height greater than the height of the shower curtain or door structure used therewith. Shower curtains are typically arranged to hang from a curtain rod mounted across the open side of a stall area and spaced (for example, 1 to 2 feet) from the ceiling over the stall area. Likewise, door structures, as discussed above, are typically supported by a door frame or a rail mounted at a location which is spaced (for example, 1 to 2 feet) from the ceiling over the stall area. As a result, warm air and steam tend to rise within the stall area and escape through an open space or gap formed between the top of the curtain or door structure and the ceiling. This escape of warm air and steam effects a loss of heat from, and thus a cooling of, the stall area. Additionally, the moisture which escapes from the open space or gap in the stall areas tends to collect on nearby walls, ceilings, cabinets and other structures. Such moisture commonly causes water rot and other types of water damage to structures in or near the stall area.

Attempts at closing the open space or gap typically formed in the upper portion of stall areas has resulted in such structures as those shown in U.S. Pat. No. 3,864,760 to Bowen, and U.S. Pat. No. 4,333,187 to Schuler.

Bowen describes a stall area or bathing facility 10 which includes sliding doors 12 supported by a rail 22. The rail is mounted between opposing walls 18, and is spaced from the ceiling 20 extending over the bathing facility 10. A curved or dome-shaped sheet member 30 extends over the bathing facility 10, between the ceiling 20 and the rail 22. The sheet material 30 is specifically shaped to be supported on one side by the door rail 22 and on an opposing side by an L-shaped bracket 38 which is fixed to a wall 16 by screws 40. The sheet 30 is somewhat bendable, but must be relatively rigid in order to maintain its curved or dome-shaped configuration. Because of its relative rigidity, the sheet material 30 is bulky and cumbersome to install, store, and package. Additionally, due to its relative rigidity, the sheet material 30 must be sawed rather than folded or bent in order to adjust (by shortening) its length to accommodate a shorter stall area. Furthermore, sheet material 30 can not be adjustably lengthened, e.g., by unfolding or stretching, in order to accommodate a longer stall area.

Schuler describes a shower curtain which includes a pair of main panels 11 supported in a hanging relationship by a curtain rod 50. The curtain rod 50 is mounted in a shower stall area between two opposing walls 42, 42, and is spaced from the ceiling 43 extending over the stall area. A netting panel 15 is supported by curtain rod 50 and extends from the upper portion of panels 11 toward the ceiling 43. However, as shown in FIG. 5, a gap or spacing remains between the ceiling and the panel 15. Additionally, the panel 15 does not prevent, and may even promote, the accumulation of moisture on the ceiling and wall surfaces at the upper portion of or above a stall area.

SUMMARY OF THE INVENTION

The present invention relates to an improved closure for use in a space at the upper portion of a stall area for a bath, shower, spa or the like, to provide an humidity and heat barrier. According to an embodiment of the present invention, a foldable thin sheet of material is supported by a framework mounted in the upper portion of the stall area. The framework is designed to be supported in the upper portion of the stall by urging against two opposing walls. The framework and the sheet are readily assembled and disassembled, and when dissembled, can be stored in a relatively compact package.

A highly flexible material, such as a thin vinyl sheet or a fabric sheet, is chosen for the foldable sheet. As a result, the length and the width of the sheet, and thus the length and width of the closure, may be adjusted by bunching or folding up excess sheet material, or by stretching out or unfolding bunched up sheet material. Additionally, in a disassembled state, the foldable sheet may be folded, rolled, or bunched up into a relatively compact package.

According to embodiments of the invention, the framework includes two extensible rods which urged against, and are thereby supported by, the upper portions of two opposing walls of the stall area. The two extensible rods are arranged in parallel at substantially equal heights in the stall area. A third rod is arranged parallel to the two extensible rods and is held at a height above the height of the two extensible rods by support rods extending from the extensible rods. The flexible sheet is laid on the third rod and the supports and is supported by the framework in an inverted V-shaped arrangement.

The closure structure according to embodiments of the present invention may be readily installed in an existing stall area for a shower, bath, spa, or the like, without requiring modification of the existing stall structure, and without requiring the use of tools (it is noted that scissors may optionally be used to cut or trim the flexible sheet). The closure can be readily adjusted to accommodate various lengths and widths of existing stall areas. Additionally, the closure can be readily assembled and dissembled by relatively simple processes, without the use of tools. When disassembled, the closure can be accommodated in a relatively small package for easily storage and transportation. Other objects, benefits and features of the present invention will be apparent from the following description.

BRIEF DESCRIPTION OF THE DRAWINGS

The detailed description of the invention will be made with reference to the accompanying drawings, wherein like numerals designate corresponding parts in the several figures.

DETAILED DESCRIPTION OF PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
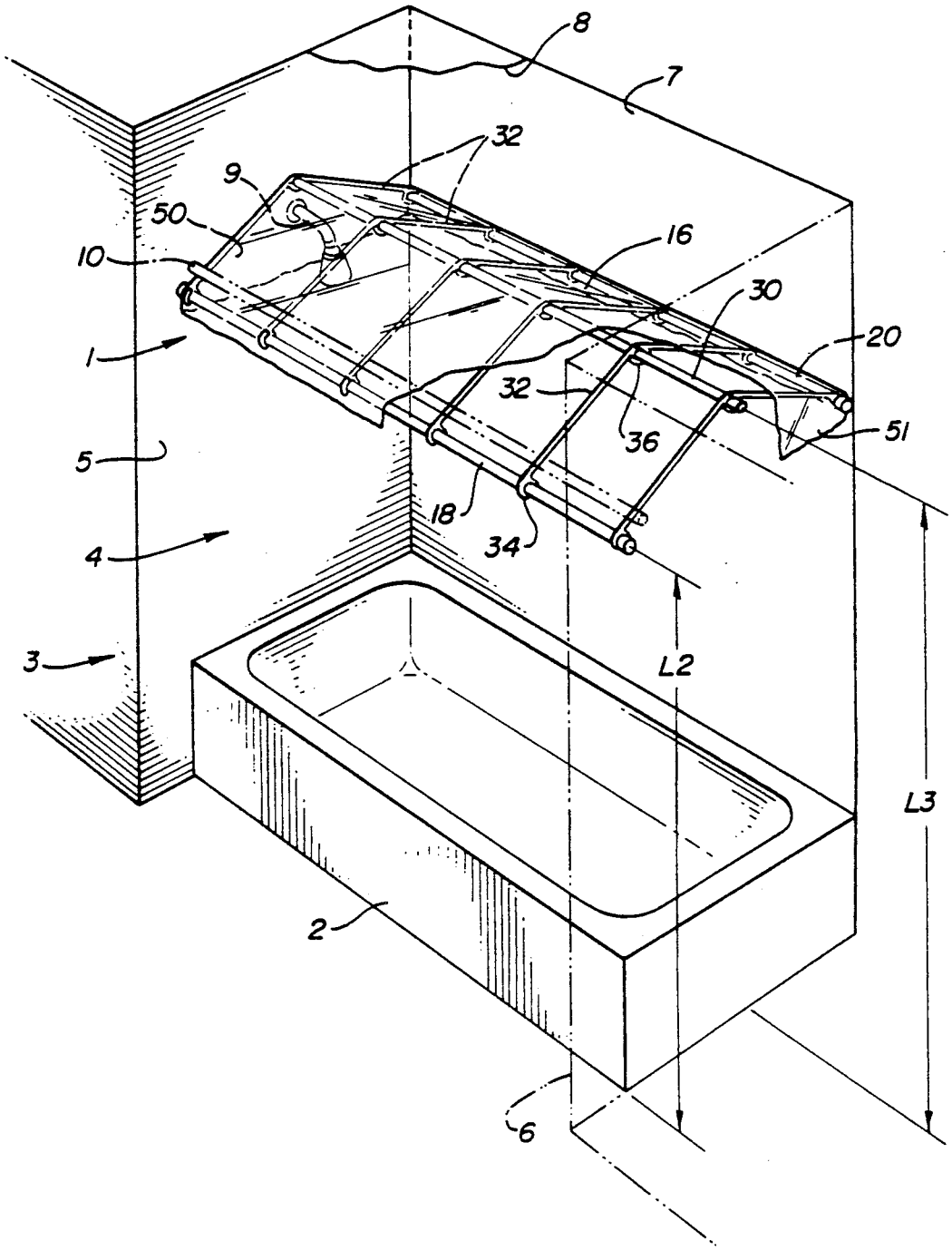
FIG. 1 is a perspective view of a stall area provided with a closure according to an embodiment of the present invention.
Figure 2:
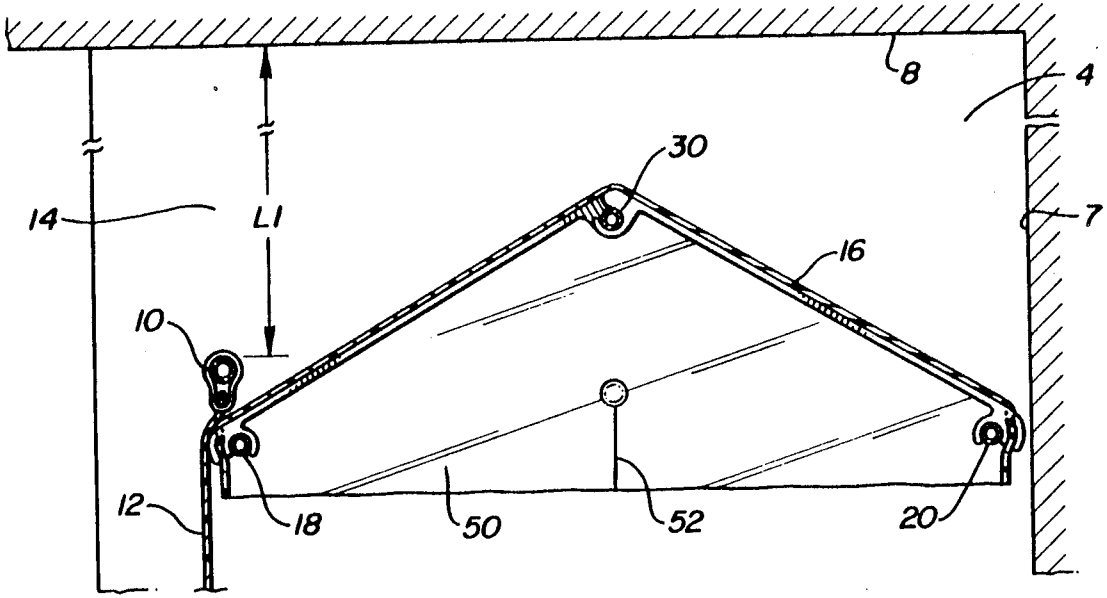
FIG. 2 is a cross-section view of the closure of the embodiment shown in FIG. 1.
Figure 3:
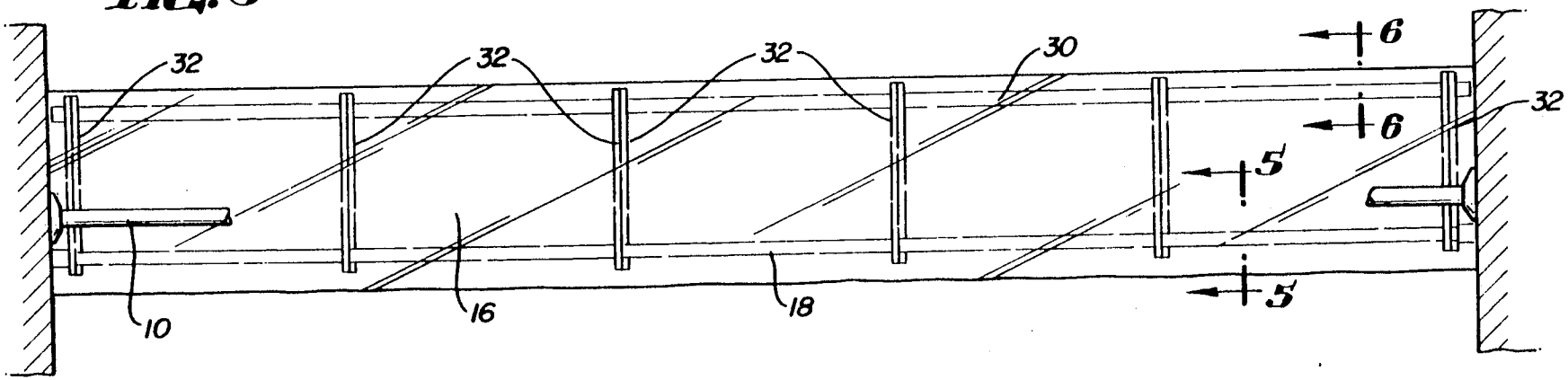
FIG. 3 is a side view of the closure of the embodiment shown in FIG. 1.

A closure assembly according to an embodiment of the present invention is generally indicated at 1 in FIGS. 1-3, as it appears when installed over a tub 2 in a conventional shower stall area 3.

The shower stall area 3 includes a space 4 bounded by three walls 5, 6, and 7. Tub 2 is disposed in space 4, with wall 5 adjacent one end of tub 2, wall 6 adjacent to the opposite end of tub 2, wall 7 adjacent one side of tub 2, and a ceiling 8, provided over tub 2. The forth side of tub 2 is not adjacent a wall, and, in this regard, is open to allow access into and out of tub 2. A shower head 9 is mounted on end wall 5. A curtain rod 10 extends between end walls 5 and 6 and supports a shower curtain 12. Curtain rod 10, and thus the top of curtain 12, is mounted below ceiling 8 and is spaced from ceiling 8 by a distance L1. Thus, even when curtain 12 is drawn closed, there is a gap or opening, as indicated at 14, above the top of curtain 12 and between end walls 5 and 6.

The above description of shower stall area 3 is intended to represent a conventional stall area in which the present invention may be employed. It will be recognized, however, that the present invention may be employed with any suitable stall area for a bathtub, shower, spa, or the like, and is not to be limited for use with the particular stall area 3 described above.

When installed, closure assembly 1 shown in FIGS. 1-3, provides a barrier which blocks the escape of heat and humidity through the opening 14. Closure assembly 1 is also useful for this same purpose in a stall area having a door structure instead of a shower curtain, where the top of the door structure is arranged below and spaced from ceiling 8 of stall area 3.

As illustrated in FIGS. 1-3, closure assembly 1 resembles a canopy having a framing structure extending between end walls 5 and 6 above tub 3 and a sheet 16 of flexible material supported by the framing structure. The framing structure comprises a pair of extensible rods 18 and 20 extending between end walls 5 and 6. As illustrated in FIG. 1, extensible rod 18 is arranged adjacent curtain rod 10 (or the top of the door structure, not shown) at a height L2 within stall area 3, and extensible rod 20 is arranged adjacent side wall 7, at the same general height L2 as extensible rod 18.

Figure 4:
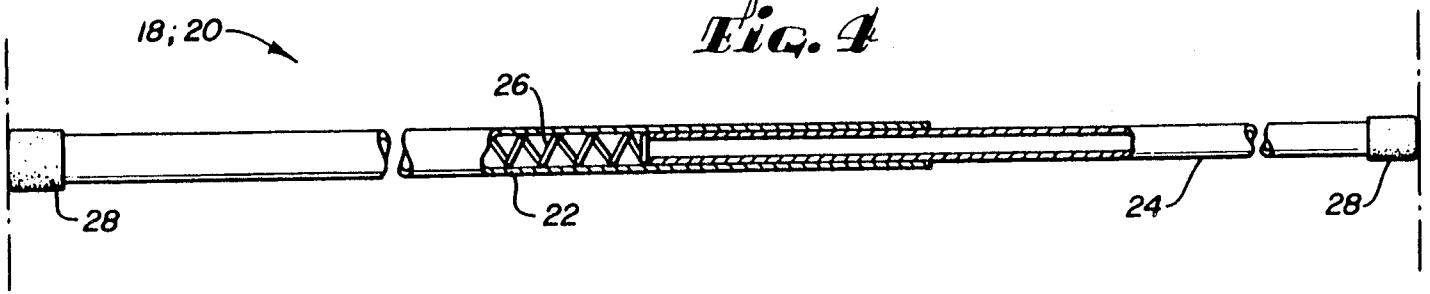
FIG. 4 is a cut-away view of an extensible rod according to the closure of the FIG. 1 embodiment.

Each extensible rod 18 and 20 is, preferably, a rod having a telescoping configuration, comprising, as shown in FIG. 4, an outer tubular member or sleeve 22 and an inner member 24 slidable in the outer member and biased by a spring 26 to extend out from the outer member. Each extensible rod 18 and 20 is provided such that, when fully extended, its length is greater than the distance generally encountered between end walls 5 and 6 in typical stall areas. In this manner, extensible rods 18 and 20 are adapted to be retracted to fit between end walls 5 and 6 and, as a result of spring biasing forces, are then allowed to expand in length to frictionally engage ends walls 5 and 6. Suitable friction heads 28 may be provided at the outer end of rod members 22 and 24 for augmenting the frictional engagement with end walls 5 and 6.

The above-described spring biased telescoping configuration allows extensible rods 18 and 20, and thus the framing structure, to be adjusted in length (as measured by the distance between end walls 5 and 6 in FIG. 1) so as to accommodate various stall area lengths. Also, the spring biased telescoping configuration allows extensible rods 18 and 20, and thus closure assembly 1, to be mounted or removed from stall area 3 without requiring modifications to stall area 3 and without requiring the use of tools. It will be recognized, however, that other suitable rod configurations may be used as an alternative to the spring biased telescoping configuration discussed above. For example, extensible rods 18 and 20 may be provided in the form of a threaded telescoping structure wherein an outer sleeve is threadably engaged with an inner member to provide a threadably adjustable rod structure; that is, a rod structure which is adjustable in length by threading the inner member into or out of the outer sleeve.

The framing structure also includes a third rod 30 which is positioned to extend generally parallel to extensible rods 18 and 20 and it is substantially centered with respect to extensible rods 18 and 20. As shown in FIGS. 1 and 2, third rod 30 is disposed in a horizontal plane above the horizontal plane of extensible rods 18 and 20, at a height L3 within stall area 3. Preferably, third rod 30 has a length somewhat less than the minimal distance generally encountered between end walls 5 and 6 of a typical stall area. Third rod 30 may be a tubular rod of any suitable material, preferably plastic, and may be adjustable in length in a manner similar to that of extensible rods 18 and 20 or of third rod 60 described below with respect to the embodiment shown in FIG. 7.

The framing structure further comprises a plurality of supports, each of which is generally designated at 32. As shown in FIGS. 1 and 3, each support 32 comprises a rod-like member which extends between one of the extensible rods 18 and 20 and the third rod 30 for supporting the third rod 30 at height L3 (and for supporting sheet material 16 as will be described below).

Supports 32 are assembled with extensible rods 18 and 20 such that a first plurality (six in FIGS. 1–3) of supports 32 extend between extensible rod 18 and third rod 30 at spaced intervals along the length of extensible rod 18, and a second plurality (six in FIGS. 1–3) of supports 32 extend between extensible rod 20 and third rod 30 at spaced intervals along the length of extensible rod 20.

Each support 32 has a spring clip 34 at one end and a spring clip 36 at an opposite end. Spring clip 34 is provided to allow quick and easy, snap-together-assembly of support 32 with one of the extensible rods 18 or 20. Spring clip 36 is provided for allowing quick and easy snap-together-assembly of support 32 with third rod 30. Preferably, each support 32 comprises a molded plastic rod-like member having spring clips 34 and 36 integrally molded at opposing ends of the rod-like member.

Figure 5:
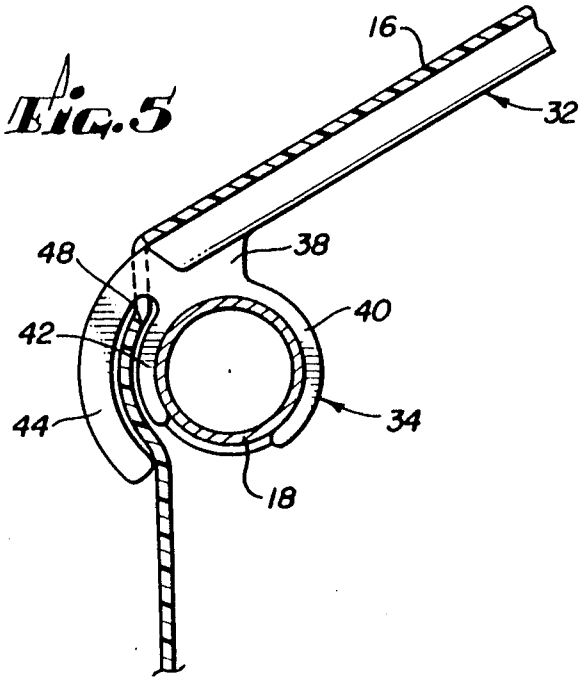
FIG. 5 is a cross-sectional view of a spring clip arrangement employed in the closure of the FIG. 1 embodiment.

Each spring clip 34, as best shown in FIG. 5, includes a C-shaped portion 38 formed by a first curved arm 40 and a second curved arm 42. Curved arms 40 and 42 provide a continuous arc of a diameter equal to or slightly smaller than the diameter of extensible rods 18 and 20. Preferably, curved arms 40 and 42 are elastic allowing the arms to spread apart and receive one of the extensible rods 18 and 20 within the C-shaped portion 38, and then snap or spring back around the received extensible rod, as shown in FIG. 5. Each spring clip 34 also includes a hook member 44 which, as will be described below, acts as a catch for holding sheet material 16 on the frame structure.

Figure 6:
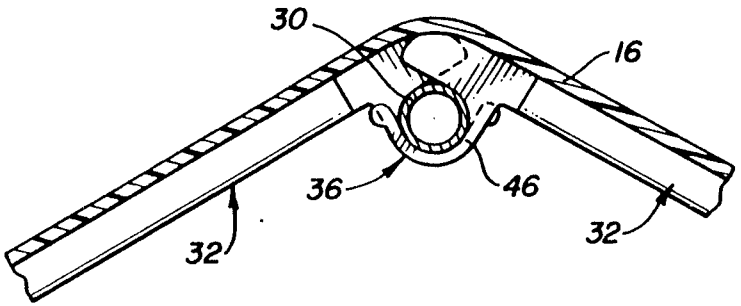
FIG. 6 is a cross-sectional view of another spring clip arrangement employed in the closure of the FIG. 1 embodiment.

Each spring clip 36, as best shown in FIG. 6, includes a curved arm 46, which is curved about an arc having a diameter equal to or slightly less than the diameter of third rod 30. Preferably, curved arm 46 is elastic, allowing the arm to partially unbend and open the arc so as to receive third rod 30 therein, and to then snap or spring back around third rod 30, as shown in FIG. 6.

Spring clips 34 and 36 are offset to one side of each support 32; that is, spring clips 34 and 36 are offset with respect to the axis of the rod-like structure of each support 32. In this manner, each support 32 may be arranged in an inclined position, with spring clip 34 at its lower end and opening downward for clipping onto one of the extensible rods 18 or 20, as shown in FIG. 5, and spring clip 36 at its upper end and opening upwardly at an angle for clipping onto third rod 30, as shown in FIG. 6.

The above-described framing structure operates to support a flexible sheet 16 in an inverted V-shaped configuration as illustrated in FIGS. 1 and 2. Preferably, sheet 16 is made of a material which can be used as a barrier for moisture and heat. Additionally, it is preferred that sheet 16 comprise a suitably flexible material, such as plastic sheeting, vinyl sheeting, fabric sheeting, or the like. Also, it is preferred that sheet 16 be transparent to allow the passage of light therethrough.

Sheet 16 can be substantially rectangular-shaped, provided with a suitable length and width for overlaying the erected framing structure described above. Sheet 16 may be provided with holes 38, which may be grammeted, at spaced intervals along each lengthwise side margin of the sheet, for receiving the hook members 44 formed integrally with supports 32. Each of the hook members 44 extends through one of the holes 38 so as to attached sheet 16 to the framing structure. The frame structure and sheet 16, when arranged within stall area 3 as shown in FIGS. 1-3, form a closure (and a moisture and heat barrier) for closing the gap or opening 14 above the curtain rod or door structure in a conventional stall area.

As noted above, extensible rods 18 and 20, and thus the entire frame structure, may be adjusted in length, so as to accommodate various stall area lengths. Since sheeting 16 is made of a flexible, or foldable, material, sheeting 16 may be adjusted in length to accommodate various stall lengths merely by folding or bunching up excess sheeting material to shorten the length, or by unbunching or stretching out bunched up sheeting material to enlarge the length. Additionally, it will be noted that the width and height of the closure assembly may be adjusted by adjusting the relative distance between extensible rods 18 and 20. Extensible rods 18 and 20 may be arranged relatively close to each other to provide a closure assembly having a relatively narrow width and a relatively large height. Alternatively, extensible rods 18 and 20 may be spaced apart by a relatively large distance in order to provide a closure assembly which is relatively wide and has a relatively small height. The above-described closure assembly is, therefore, readily adjustable to accommodate various sizes of stall areas.

It is contemplated that a closure assembly, according to the above-described embodiments, may be supplied as a kit, comprising the pair of extensible rods 18 and 20, the third rod 30, a set of supports 32 and a sheet 16. To install the closure assembly, the extensible rods 18 and 20 are set in place between end walls 5 and 6 at the requisite level (L2), these rods being retained in place by frictional engagement of their end heads 28 with end walls 5 and 6. Supports 32 are then clipped by means of spring clips 34 to extensible rods 18 and 20. Sheet 16 is then placed on extensible rods 18 and 20, and hook members 34 are entered through holes 38 in the sides of sheet 16. Third rod 37 is then held below sheet 16 and supports 32 are clipped by means of spring clips 36 to third rod 30, the supports 32 at this point being inclined downwardly from extensible rods 18 and 20. Then, supports 32 are swung up to raise third rod 30 is its elevated position (L3), sheet 16 being stretched over third rod 30 in this process. Supports 32 adjacent end wall 5 (where showerhead 9 is located) may be initially spaced from wall 5 so as to clear the showerhead. Supports 32 may, thereafter, be slid toward wall 5 and over showerhead 9. The framing structure and sheet 16 are thereby provided with incline portions on opposite sides of third rod 30. The inclined portions slope upwardly from extensible rods 18 and 20 toward third rod 30 to form an inverted V configuration. This configuration insures that the users of the shower, bath, spa, or the like, will be provided with sufficient head room and that the closure will accommodate and enclose showerhead 9.

It is contemplated that sheet 16 may be provided with generally triangular end panels 50 and 51 as illustrated in FIG. 2. One end panel 50 may be arranged adjacent wall 5, while a second end panel 51 may be arranged adjacent wall 6. The end panels 50 and 51 provide further heat and moisture sealing functions, as well as providing water rot and water damage protection for walls 5 and 6. End panel 50, which is disposed toward end wall 5, may be slit as indicated at 52 in FIG. 2 to allow showerhead 9 to extend through panel 50.

Figures 7, 8:
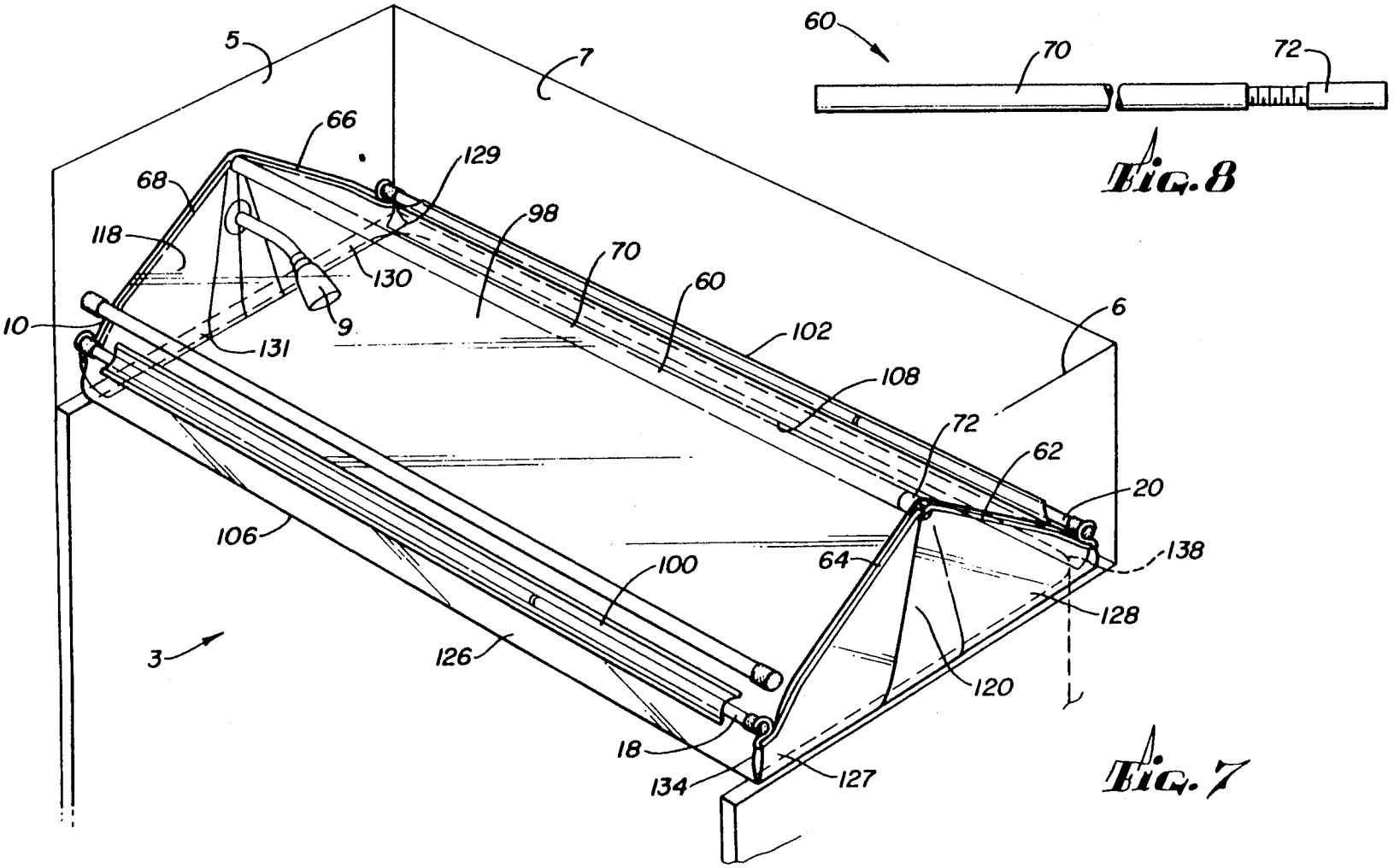
FIG. 7 is a perspective view of a closure according to another embodiment of the present invention.
FIG. 8 shows a portion of third rod 60 employed in the FIG. 7 embodiment.

FIG. 7 shows another embodiment of the present invention in which a framing structure supports a flexible sheet of material in an inverted V-shaped configuration to provide a closure for purposes similar to those for which the embodiment of FIGS. 1–6 is provided. The closure structure shown in FIG. 7 employs extensible rods 18 and 20, similar to those employed in the embodiment of FIGS. 1–6. The above-description of the function, operation, and structure of extensible rods 18 and 20 is incorporated herein by reference.

The closure assembly shown in FIG. 7 includes a third rod 60 which, like third rod 30 shown in FIGS. 1 and 2, is supported at a height above the height at which extensible rods 18 and 20 are disposed within stall area 3. However, instead of using the supports 32 shown in the FIGS. 1–6 embodiment, third rod 60 is supported by struts 62, 64, 66, and 68, as will be described below.

Each end of third rod 60 is opened into a hollow interior portion of third rod 60. Third rod 60 may be adjustable in length so as to accommodate various stall lengths. For example, third rod 60 may comprise a main rod 70 and one or more extension rods 72 threadably secured with the main rod 70. Accordingly, third rod 60 may be increased in length by adding (threadably securing) one or more extension rods 72 with main rod 70. Similarly, third rod 60 may be shortened in length by removing one or more extension rods 72 from main rod 70. Adjustments in the length of third rod 60 may also be accomplished by varying the extent to which an extension rod 72 is screwed into main rod 70.

The above description of one or more extension rods 72 which are threadably securable with a main rod 70 is provided merely as an example of a manner in which third rod 60 may be adjustable in length. It will be recognized that third rod 60 may comprise any other structure which provides a length adjusting feature. Moreover, it will be recognized that embodiments of third rod 60 need not be provided with length adjusting features and, thus, need not include one or more threadably securable extension rods.

Referring to FIG. 7, struts 64 and 66 constitute left-hand struts while struts 62 and 68 constitute right-hand struts. The two left-hand struts 64 and 66 are substantially equivalent to each other in shape, while the two right-hand struts 62 and 68 are substantially equivalent to each other in shape. Left-hand strut 64 is shown in FIG. 9, while right-hand strut 62 is shown in FIG. 10.

Figure 11:
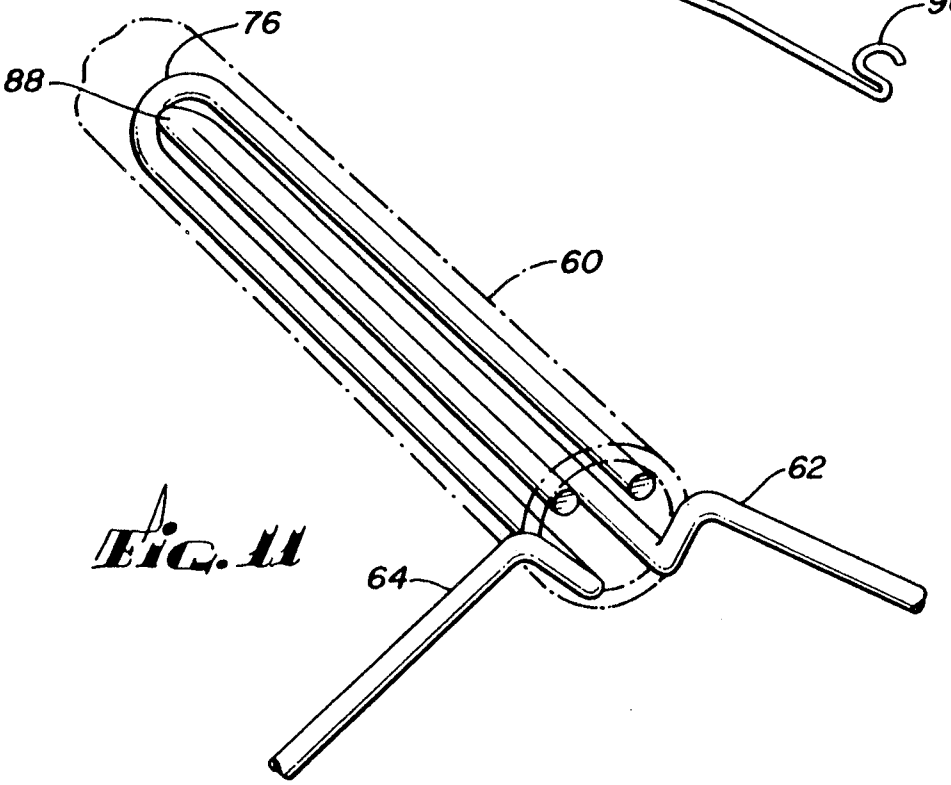
FIG. 11 is a perspective view of the connection arrangement of struts and the third rod employed in the FIG. 7 embodiment.
Figure 9:
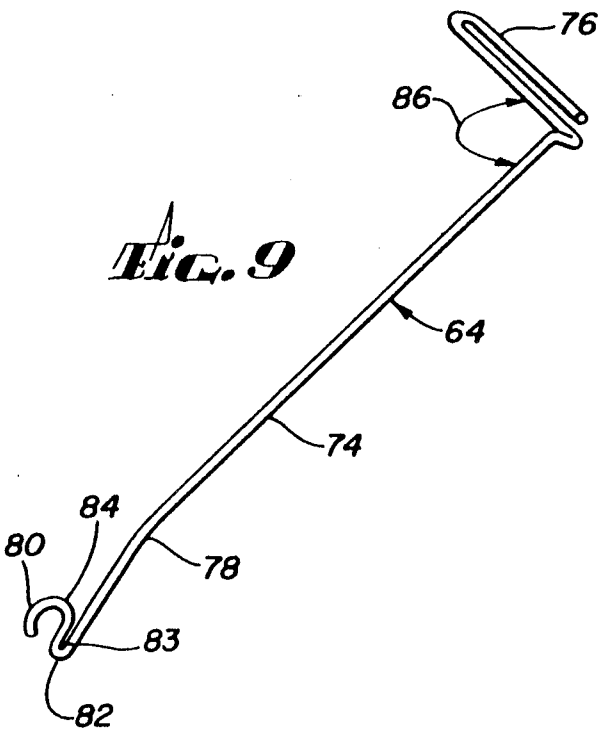
FIG. 9 is a perspective view of a left-handed strut employed in the FIG. 7 embodiment.

Referring to FIG. 9, left-hand strut 64 includes a generally straight portion 74 and a U-shaped bend 76 extending to the left of the generally straight portion 74. The U-shaped bend 76 provides an insertable portion which is insertable in one end of third rod 60, as shown in FIG. 11. Strut 64 illustrated in FIG. 9 also includes a slight bend 78 bent to the right with respect to the generally straight portion 74.

A hook portion 80 is provided at the opposite end of strut 64 with respect to the end at which the U-shaped portion 76 is provided. The hook portion 80 is an S-shaped configuration having a first bend 82 at which the end of strut 64 is bent toward the U-shaped portion 76, and a second bend 84, at which the end of strut 64 is bent away from U-shaped portion 76. The inner circumference of the second bend 84 fits about an end cap 28 as shown in FIG. 7. Note that an obtuse angle 86 is formed between the U-shaped portion 76 and the generally straight portion 74 of strut 64. This obtuse angle 86 causes the hooked portion 84 of strut 64 to press against one of the end walls 5 and 6 of stall area 3 when the closure is assembled as shown in FIG. 7. In this manner, each strut acts as a preloaded spring between third rod 60 and an end wall 5 or 6. This spring action operates to secure strut 64 with extensible rod 18, and to assist in mounting the closure assembly to end walls 5 and 6.

Figure 10:
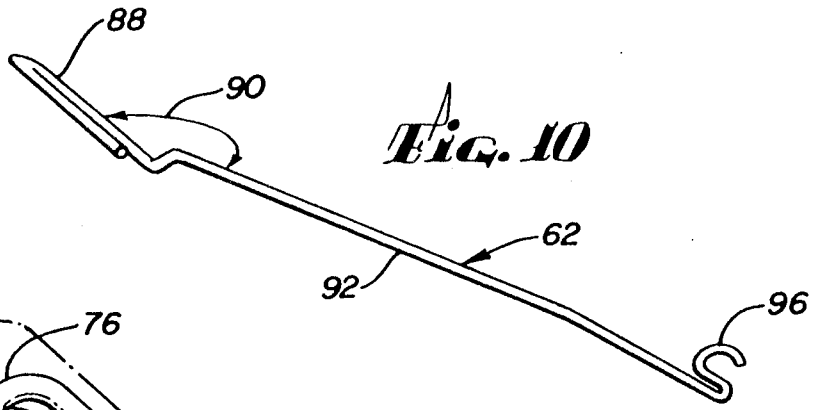
FIG. 10 is a perspective view of a right-handed strut employed in the FIG. 7 embodiment.

Right-hand strut 62 is shown in FIG. 10. It will be recognized that right-hand strut 68 is provided with a similar configuration shown with respect to left-hand strut 62. In order to simplify the present disclosure, it is sufficient to note that right-hand strut 62 has a configuration which would appear as substantially a mirror-image of the configuration of left-hand strut 64. In this regard, right-hand strut 62 includes a U-shaped portion 88 provided at an angle 90 with respect to a substantially straight portion 92 of right-hand strut 62. As a result, hook portion 96 of right-hand strut 62 fits about an end cap 28 of extensible rod 18 and presses against end wall 5 when assembled as shown in FIG. 7.

The U-shaped portion 76 or 88 of each strut 62, 64, 66 and 68 is inserted in an end of third rod 60, as best shown in FIGS. 7 and 11. That is, one U-shaped member 76 of one left-hand strut 64 and one U-shaped member of one right-hand strut 62 is inserted in one end of third rod 60. Inserted in the other end of third rod 60 is the U-shaped portions of right and left struts 68 and 66.

Referring to FIG. 11, when inserted in an end of third rod 60, U-shaped portions 76 and 88 are nested such that one U-shaped portion (76 in FIG. 11) extends around the other U-shaped portion (88 in FIG. 11). This arrangement allows both the right- and left-hand struts 62 and 64 to secure with third rod 60 and, at the same time, to be rotatable about the axis of third rod 60. This rotatable attachment of struts 62, 64, 66 and 68 with third rod 60 allows the closure to be adjustable in height and width, as described below.

As shown in FIG. 7, a framework comprising two right-hand struts 62 and 68, two left-hand struts 64 and 66, two extensible rods 18 and 20, and one third rod 60, assembled as discussed above, supports a flexible sheet 98 in an inverted-V configuration. Flexible sheet 98 can be similar in shape and composition material to flexible sheet 16 shown in the embodiment of FIG. 1. Another embodiment of flexible sheet 98 is shown in a flattened state (not supported in the inverted-V configuration) in FIG. 12.

Figure 12:
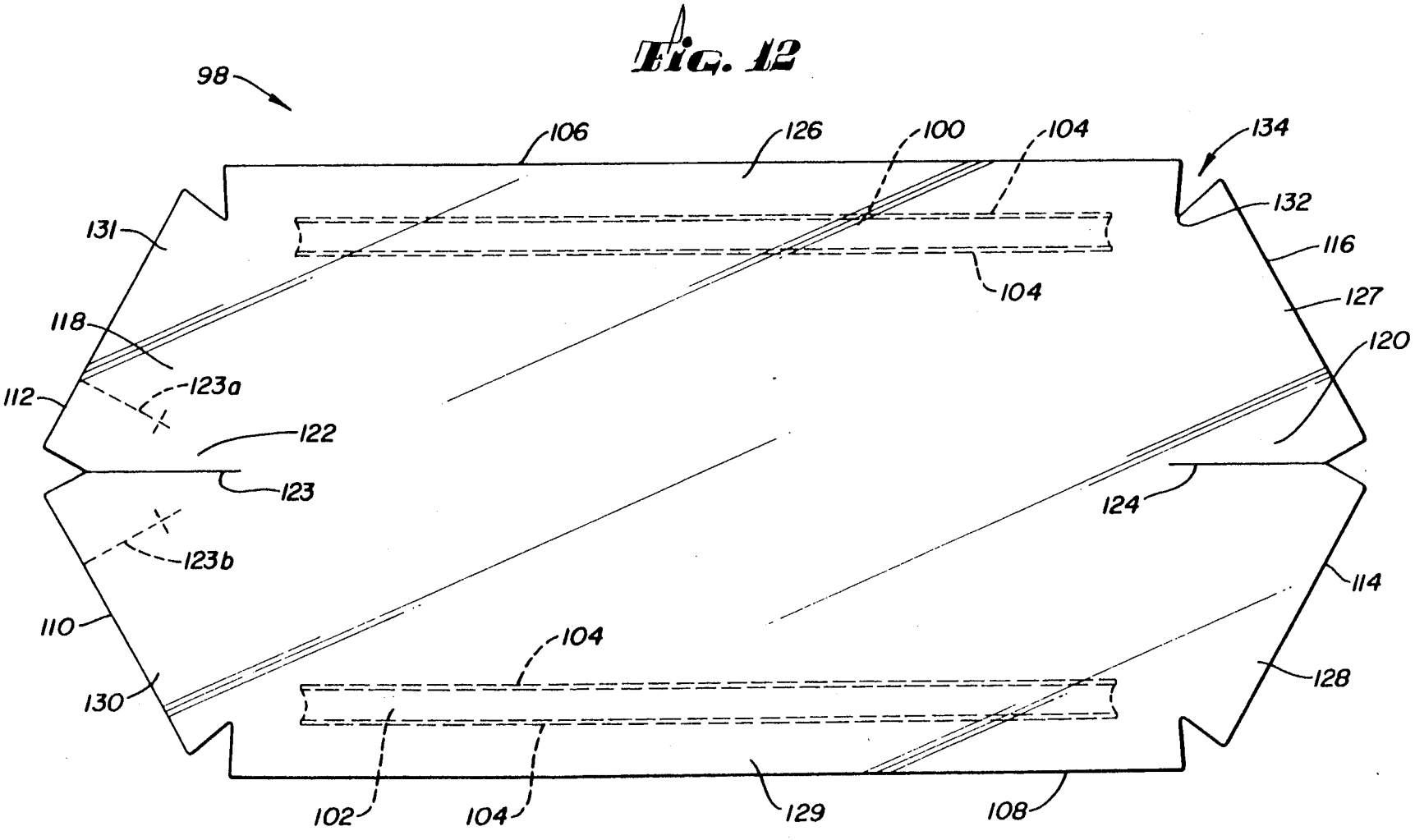
FIG. 12 is a two-dimensional view of the under side of the flexible sheet material employed in the FIG. 7 embodiment.

According to the embodiment of FIGS. 7 and 12, flexible sheet 98 is provided with a first strip 100 and a second strip 102 (shown in dashed lines in FIG. 12 to indicate their locations on the side of sheet 98 which faces into the page of FIG. 12), which are adapted to rest on extensible rods 18 and 20, respectively, when sheet 98 is supported by the above-described framework. Each strip 100 and 102 comprises an elongated member or disposed along the length of a long side of sheet 98. Strips 100 and 102 are preferably made of a material (e.g., plastic) which is more rigid and springy than the flexible material with which the remainder of sheet 98 is formed. The rigidity of strips 100 and 102 facilitates contact between wall 7 and skirt 129 and between a shower door frame (not shown) and skirt 126. Each strip 100 and 102 has two elongated edges 104 which are secured with the flexible material of sheet 98. Each strip 100 and 102 forms a tunnel through which one of the extensible rods 18 and 20 extend, as shown in FIG. 7.

Referring to FIG. 12, flexible sheet 98 is generally shaped as a six-sided polygon having V-shaped cuts provided at each of the six corners. The flexible sheet 98 has two elongated sides 106 and 108 which extend along the length of stall area 3 when the closure is assembled as shown in FIG. 7. Two short sides 110 and 112 extend between sides 106 and 108 to the left of FIG. 12, while two short sides 114 and 116 extend between sides 106 and 108 on the right of FIG. 12. The four short sides 110, 112, 114 and 116, form the lower surfaces of end panels 118 and 120 when the closure is assembled as shown in FIG. 7. Each end panel 118 and 120 is slit down the center thereof by slits 123 and 124, respectively.

As shown in FIG. 7, slits 123 and 124 divide each end panel 118 and 120, respectively, into two sections which can overlap when the flexible sheet 98 is supported in the inverted-V configuration. This overlapping arrangement of sections of each end panel 118 and 120 allow each end panel to form a triangular-shaped barrier which can be adjusted in length and height (with respect to FIG. 7) so as to conform to adjustments in the width and height of the closure shown in FIG. 7.

Since each strut is bent outward, with respect to the interior of the closure, by a bend such as that shown at 78 in FIG. 9 (with respect to strut 64), flexible sheet 98 can be stretched over the assembled framework. The stretching effect caused by the outward bend of each strut prevents flexible sheet 98 from wrinkling and, thus, provides a more aesthetically pleasing closure structure.

As shown in FIGS. 7 and 12, showerhead 9 extends through a slitted region 122, having the slit 123 and optional slits **123*a* and 123*b*, of end panel 118. Similarly, slit 124 in end panel 120 can allow a showerhead to extend therethrough when the closure is installed in a stall area in which showerhead 9 is provided on end wall 6, rather than end wall 5. Alternatively, the showerhead 9 may extend below the closure and, thus, slits 123, 123*a* and 123*b* may not be necessary. The closure may, optionally, include securing means, such as clips, snaps, hook and loop fasteners, or other suitable devices for securing the slitted end panels 118 and 120** closed (to close the slit) or closed about the showerhead or showerhead pipe.

The V-shaped cuts between connecting sides of the six-sided sheet 98 form several skirts 126–131 which extend below the framework of the assembled closure, as shown in FIG. 7. These skirts provide further sealing functions, as described below.

Figure 13:
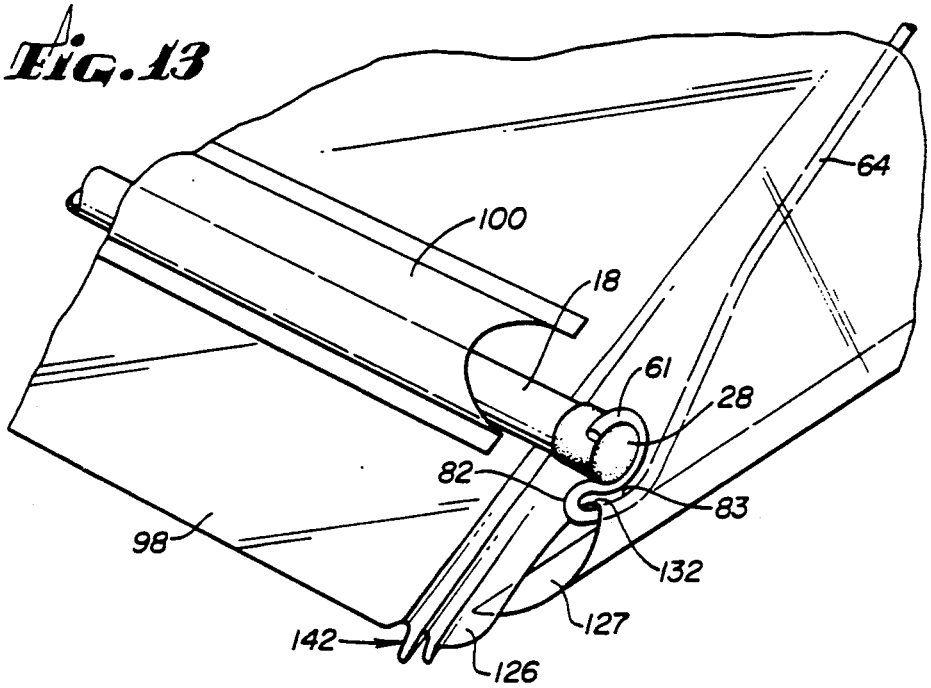
FIG. 13 is a perspective view of a portion of the assembled closure of the FIG. 7 embodiment.

The S-shaped end of each strut 62, 64, 66, and 68 provides a channel in which one of the V-shaped cut corners of flexible sheet 98 may extend. For example, referring to FIG. 13, the S-shaped end 82 of strut 64 is shown in a connecting relationship with respect to end cap 28 of extensible rod 18. A portion of flexible sheet 98 is shown as extending into channel 83 with the apex 132 (shown in FIG. 12) of the V-shaped cut 134 being centered on strut 64 to allow skirts 128 and 129 to freely hang from strut 64. In operation, flexible sheet 98 drapes over third rod 60 and struts 62, 64, 66, and 68, with V-shaped cuts arranged in a groove of the S-shaped end portion of each strut. Skirts 126–131 hang freely from all four sides of the closure to form a rectangular box-like skirt extending just below the inverted V-shaped portion of the closure.

Figure 14:
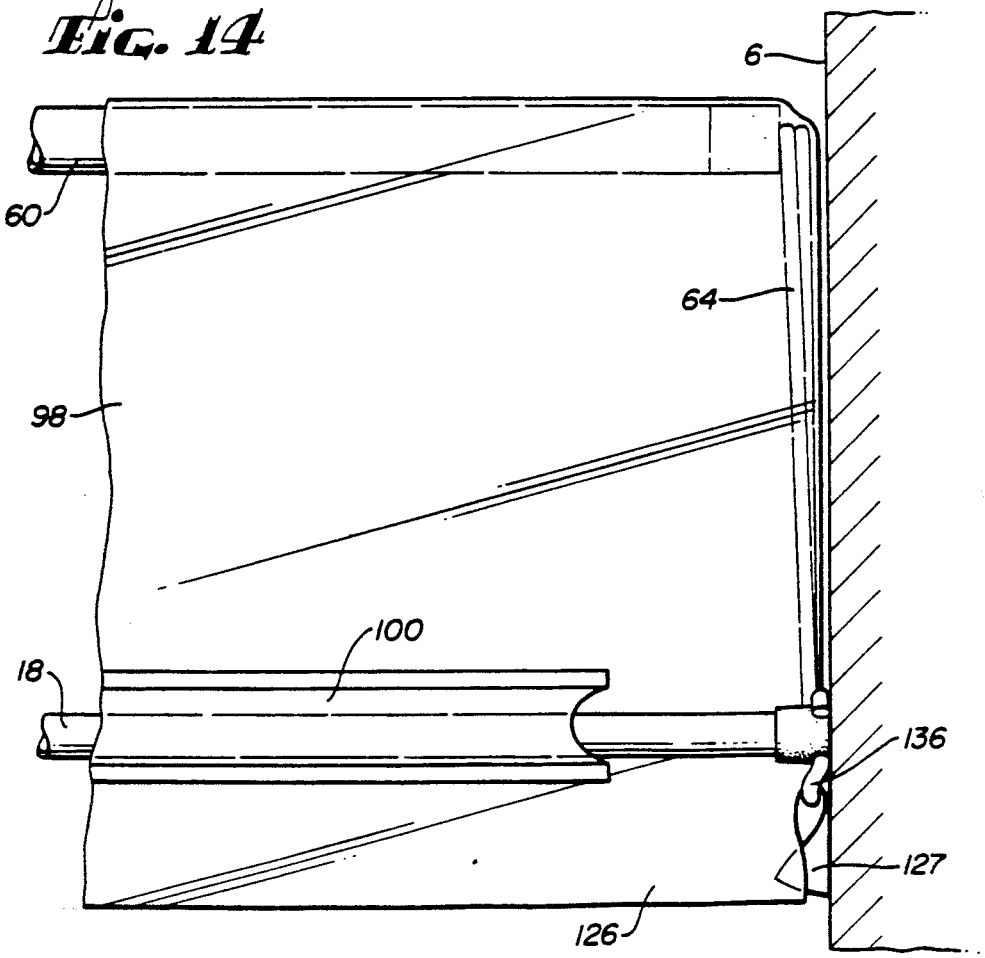
FIG. 14 is a perspective view of a portion of the assembled closure of the FIG. 7 embodiment.

As shown in FIG. 14, the S-shaped end of the strut 64 is provided with a bend 136 directed away from end wall 6 (when assembled as shown in FIG. 7) to provide clearance between strut 64 and wall 6 for skirt 127. Similar bends may be provided in struts 62, 66, and 68 to provide clearance for skirts 128, 130 and 131.

As mentioned above, skirts 126–131 provide further sealing functions, thereby enhancing the heat and humidity barrier or seal provided by the closure 0 assembly shown in FIG. 7. Skirts 126–131 are particularly useful when the closure assembly is installed for use with a stall having a curved wall, such as are commonly provided in modular stall structures. FIG. 7 shows a closure assembly installed for use with such a modular stall having a curved wall portion 138. As shown in FIG. 7, the closure is mounted above the modular stall structure between generally flat opposing walls 5 and 6. Skirts 127–131 extend to the modular stall structure 3 to seal against wall surfaces of modular stall structure 3. Skirt 126 extends to a shower curtain (not shown) supported by curtain rod 10, so as to rest against the shower curtain and further seal the closure structure. If a door structure is used as an alternative to a curtain and rod structure, skirt 126 may similarly rest against and seal with the door or the door frame. It will be apparent that the closure structure may be installed within, rather than above, a modular stall, as an alternative to the arrangement shown in FIG. 7.

Figure 15:
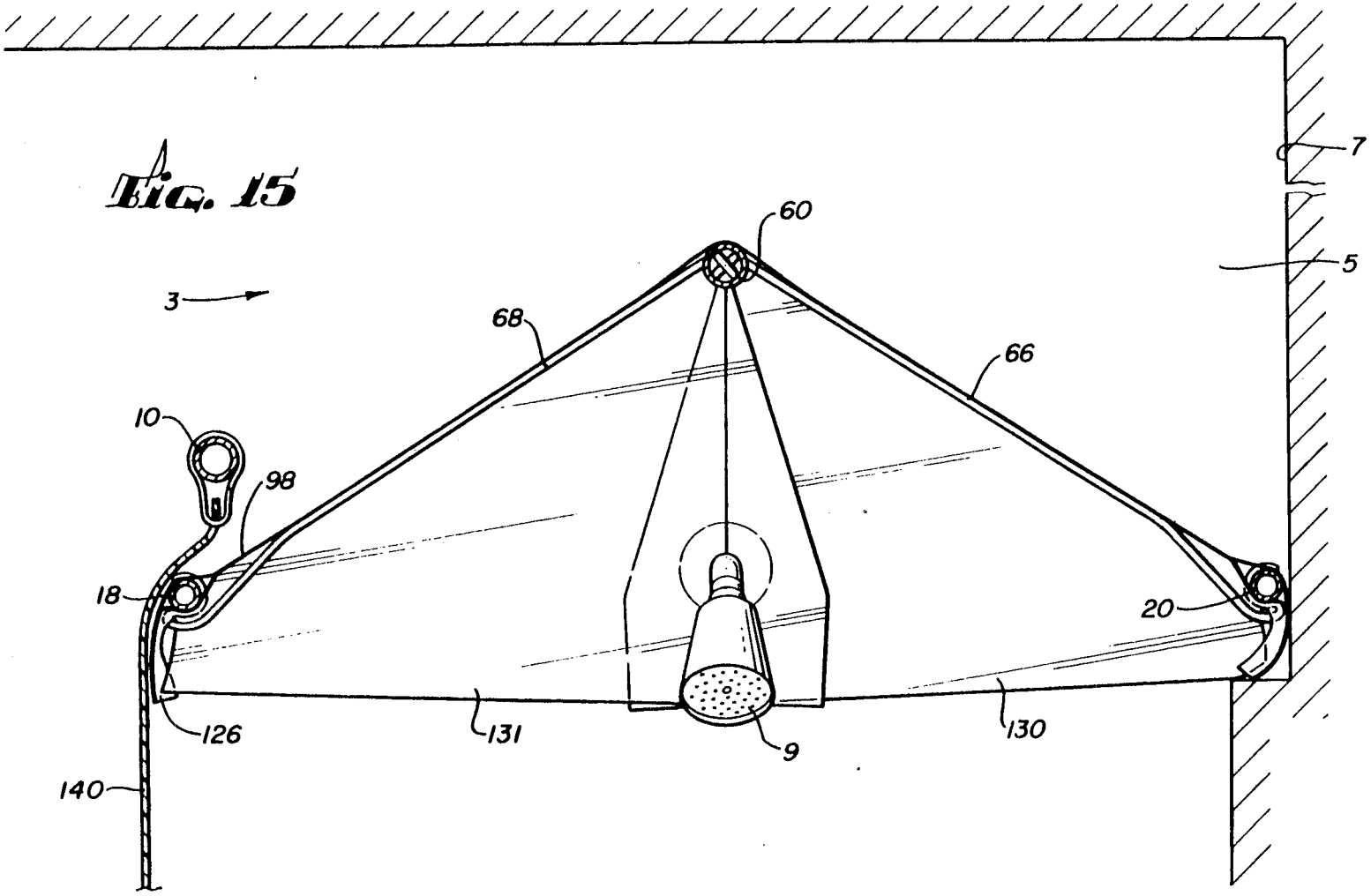
FIG. 15 is a side view of the closure of the FIG. 7 embodiment.

As shown in FIG. 15, extensible rod 18 may be arranged below and beyond (outward with respect to the stall area 3) the position of shower curtain rod 10. In this position, a shower curtain 140 will abut and press against sheet-covered extensible rod 18. This interface creates a seal between the closure and shower curtain 140. Excess shower curtain 140 may be pushed to the curtain rod ends so as to stretch out shower curtain 140 and to provide a better sealing surface for sealing against sheet 98.

The closure shown in FIG. 7 is adjustable in length, depth and height, in order to accommodate various stall sizes. Depth adjustment of the closure is accomplished by moving extensible rods 18 and 20 along end walls 5 and 6 toward and away from back wall 7 and each other. This movement causes struts 62, 64, 66 and 68 to pivot about third rod 60, as described above. Such depth adjustments of the closure also results in height adjustments of the closure.

The length of the closure (length between walls 5 and 6) is adjustable by adjusting the length of extensible rods 18 and 20 or, optionally, third rod 60, as described above. Flexible sheet 98 may be gathered and bunched up in order to accommodate a shorter frame structure (note the bunched-up portion of flexible sheet 98 shown at 142 in FIG. 13). Similarly, a bunched-up portion 142 of flexible sheet 98 may be stretched out in order to accommodate a lengthened framework.

Figure 16:
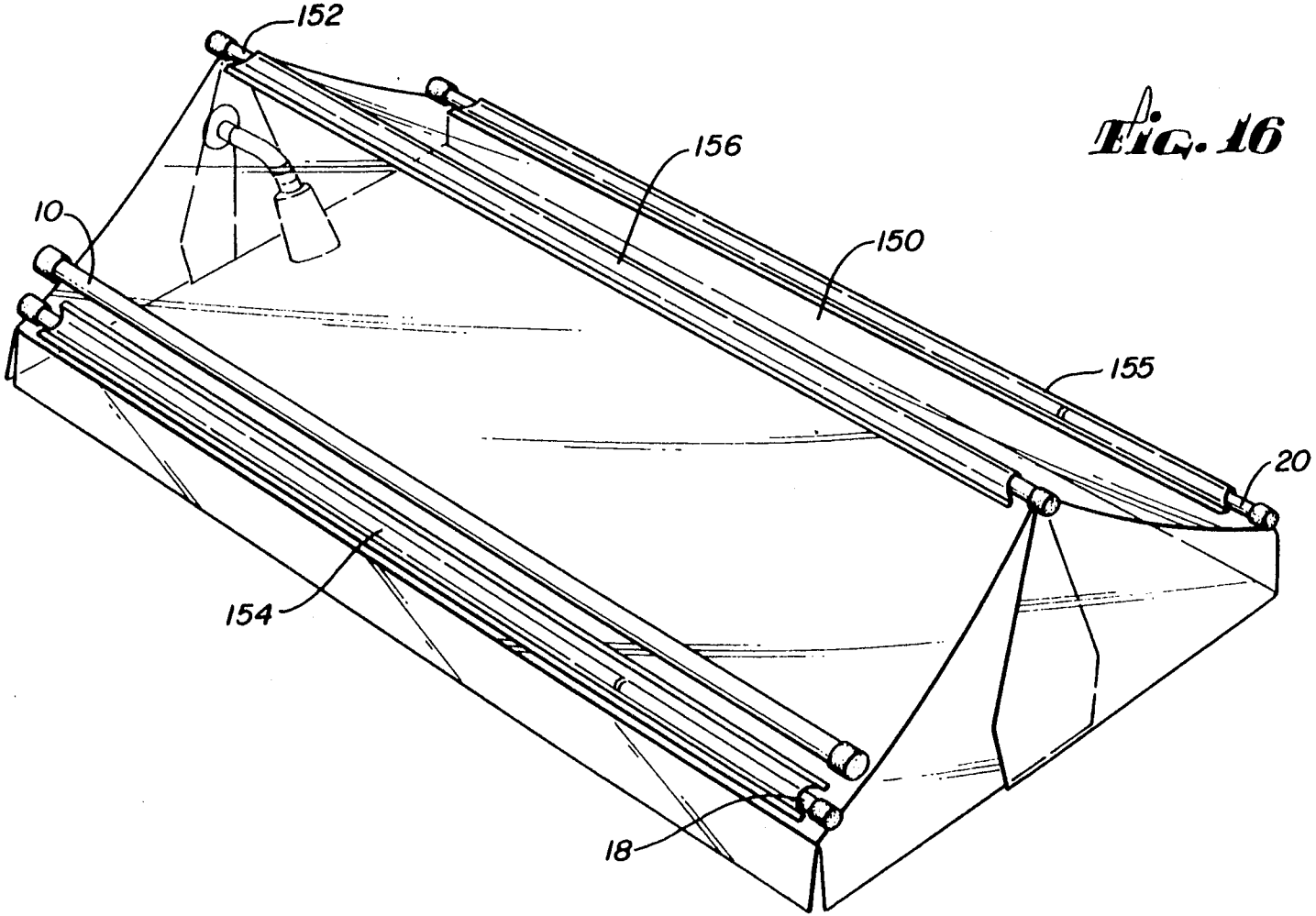
FIG. 16 is a perspective view of a closure according to another embodiment of the present invention.
Figure 17:
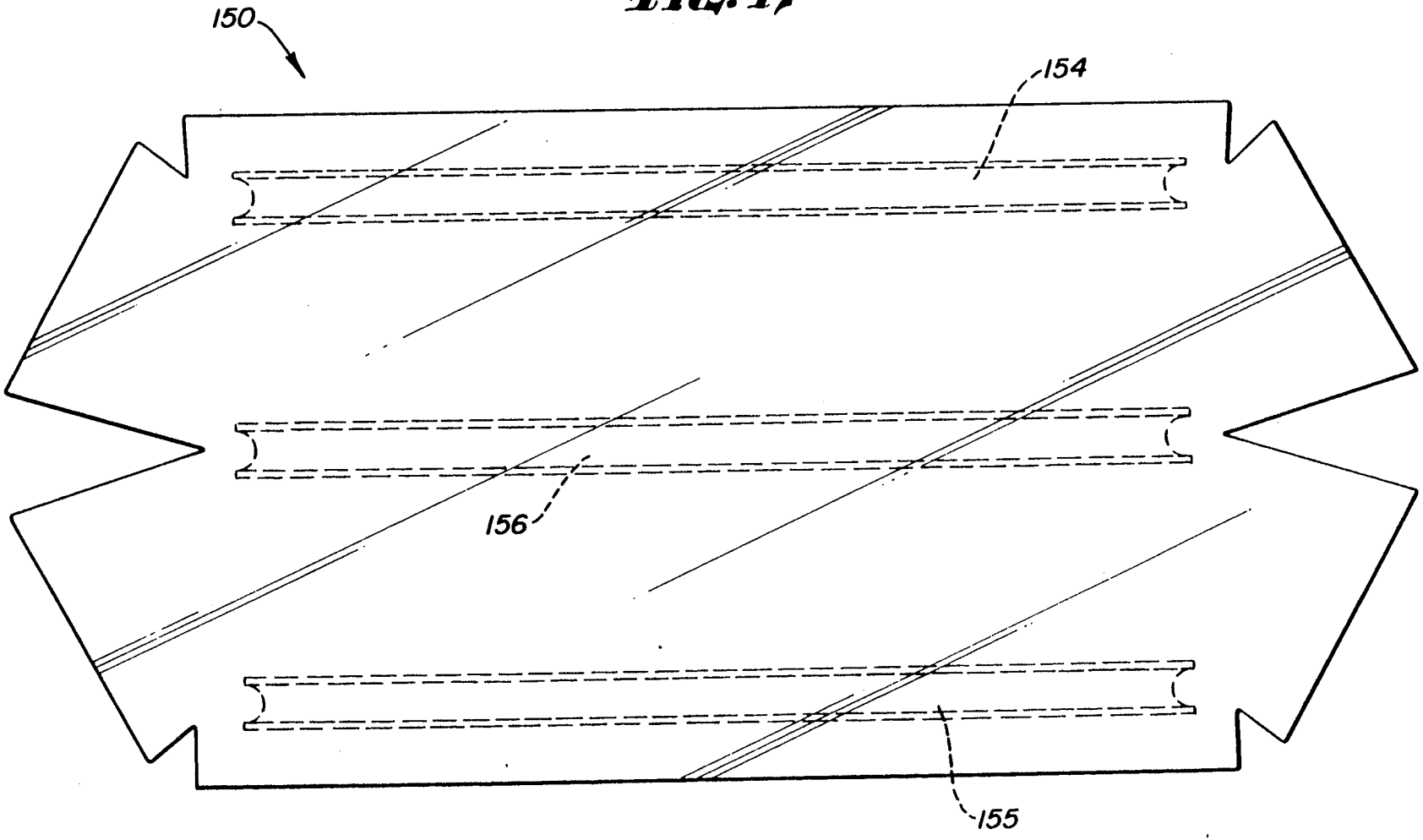
FIG. 17 is a two-dimensional view of the under side of the flexible sheet material employed in the FIG. 16 embodiment.

Another embodiment of the present invention is shown in FIGS. 16 and 17 wherein a flexible sheet 150 is supported in or above a stall area (not shown in FIGS. 16 and 17) by extensible rods 18 and 20 and a third rod in a manner similar to the embodiment of FIGS. 7 and 12. However, unlike the FIG. 7 and 12 embodiment, a third extensible rod 152 is employed instead of third rod 60. Since third extensible rod 152 urges against opposing end walls of the stall area (similar to extensible rods 18 and 20), third extensible rod 152 is self supportable and need not be supported by support rods or struts.

As shown in FIG. 17, sheet 150 is provided with three elongated strips 154–156 (shown in dashed lines to indicate their locations on the side of sheet 150 which faces into the page of FIG. 17). Similar to strips 100 and 102 in the FIG. 7 and 12 embodiment, strips 154–156 form tunnels through which extensible rods 18, 20 and 152 extend, as shown in FIG. 16. Accordingly, flexible sheet 150 is supported in an inverted V configuration by the three extensible rod 18, 20 and 152.

The framework described with regard to the embodiments shown in FIGS. 1–17 not only provides adjustability features, but also provides easy assembly and disassembly features. The framework may be readily disassembled for packing, storing, and/or shipping. Furthermore, the framework may be easily assembled and disassembled without the use of tools and without requiring modifications to existing stall areas.

Figures 18, 19:
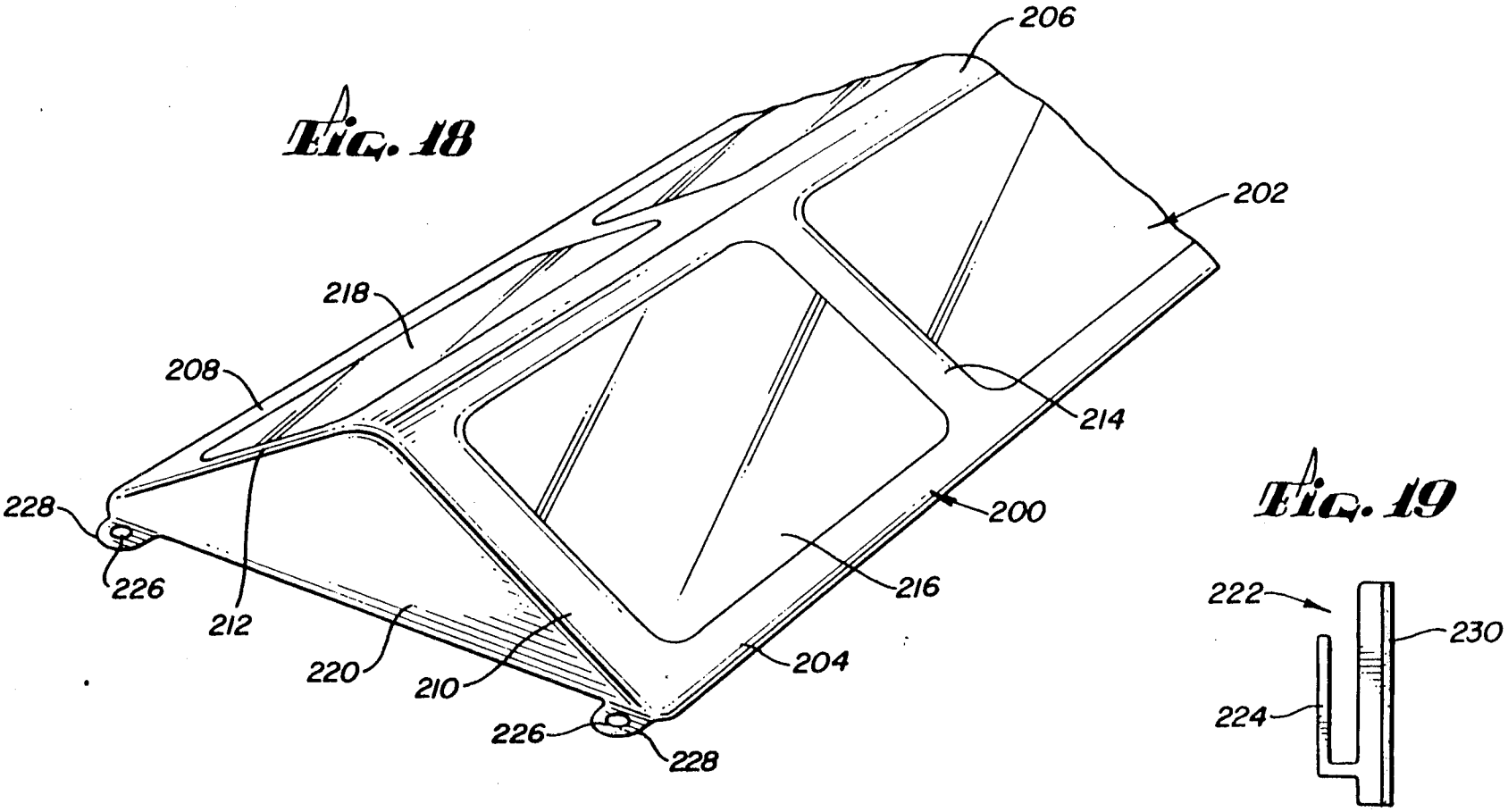
FIG. 18 is a perspective view of a portion of a closure according to another embodiment of the present invention.
FIG. 19 is a side view of a hook employed with the FIG. 18 embodiment.

Other embodiments of the present invention which provide the above-described benefits include closure structures having a flexible sheet as a barrier, wherein the flexible sheet is supported either partially or entirely by an inflatable framework. For example, referring to FIGS. 18 and 19, a closure is shown as having an inflatable framework (generally shown at 200) integral with flexible sheeting material 202. The framework 200 comprises an inflatable chamber having three parallel horizontal tubular sections 204, 206, and 208 connected by a plurality of strut sections (three of which are labeled as 210, 212, and 214). The two tubular sections and the strut sections define several generally rectangular or square-shaped areas (two of which are labeled 216 and 218) therebetween. Flexible sheeting material, such as that used for flexible sheet 16 or flexible sheet material 98 is provided across the generally rectangular or square areas (e.g., 216 and 218) and is supported by the inflatable frame in a generally V-shaped configuration, as shown in FIG. 18. Similar to the embodiments described with respect to FIGS. 1–17, the FIG. 18 embodiment may be provided with end panels 220. An adhesive-backed hook member 222 (shown in FIG. 19) is employed for mounting the closure shown in FIG. 18 to a stall area structure (such as end walls). Preferably, four adhesive-backed hooks are employed for mounting each closure. Each hook 222 includes a hook arm 224 which is shaped to engage with a hook retention hole 226 provided in a flap 228 extending from inflatable chamber 200. Each hook 222 includes an adhesive substance 230 for adhering to a stall area structure.

Figure 20:
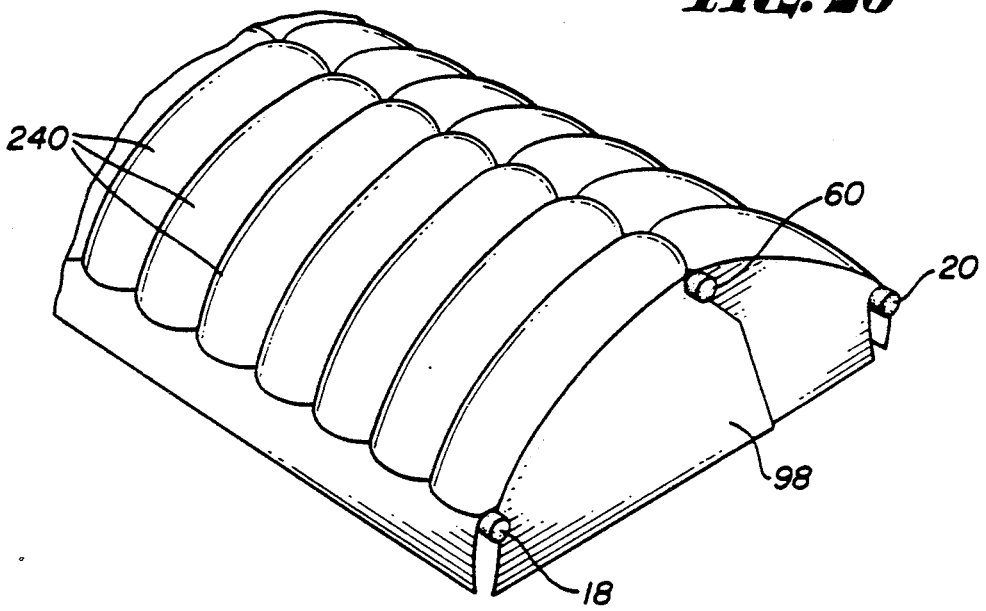
FIG. 20 is a perspective view of a portion of a closure according to another embodiment of the present invention.

In another embodiment, as shown in FIG. 20, a closure, constructed similar to that in FIG. 7, includes a plurality of inflatable tubes 240 extending on or integral with flexible sheet 98. Each inflatable tube extending from one of the extensible rods 18 and 20 to third rod 60. The inflatable tubes serve as a heat insulation which decreases the amount of condensation that would normally collect on the sheet material. The embodiment shown in FIG. 20 may be further modified to include inflatable tubes at either end of the closure (near the end walls 5 and 6 of a stall area 3) which inflate independently from the rest of the tubes and from each other. This feature will enhance the length adjustability of the closure. In another embodiment, the rigidity provided by inflatable tubes will obviate the struts and the frame.

Other embodiments of the present invention may include a flexible sheet which is made of an opaque or colored material and which is provided with transparent window panels (for example, made of transparent plastic). Furthermore, the flexible sheet may be provided with apertures through which a limited amount of heat, air and moisture may be pass. Additionally, such apertures may be provided with movable flap panels for selectively covering or closing the apertures.

Figure 21:
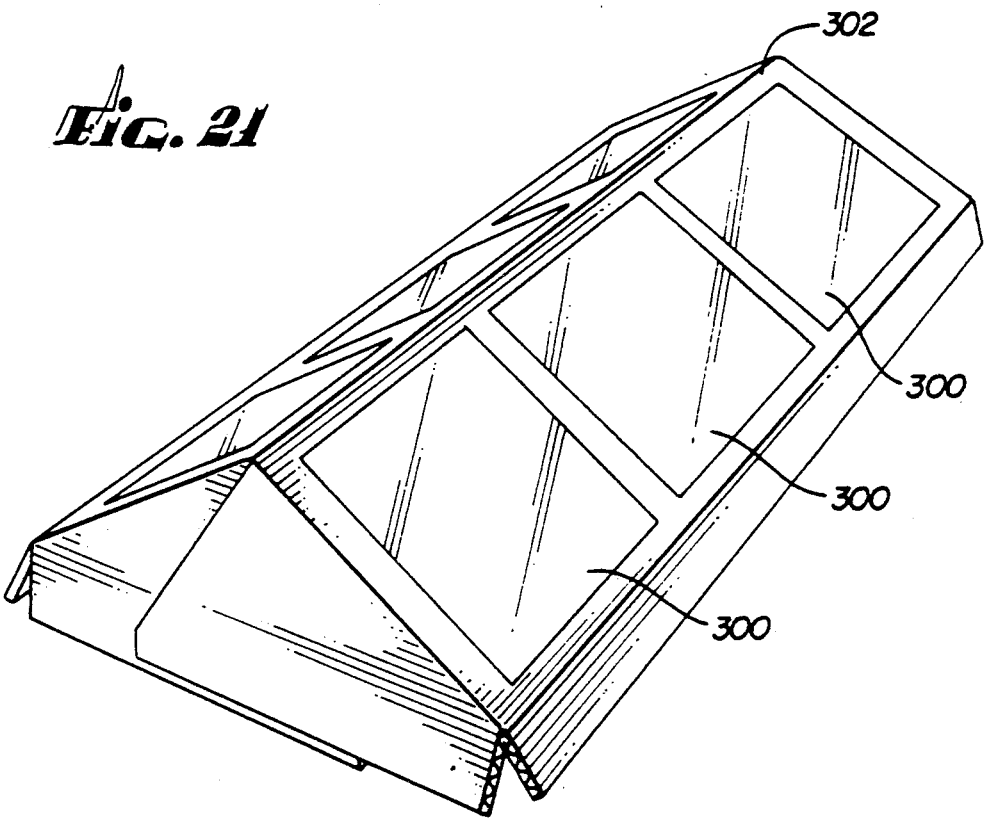
FIG. 21 is a perspective view of a closure according to another embodiment of the present invention.

In another embodiment, as shown in FIG. 21, the closure may be formed with a corrugated material (such as corrugated waterproofed cardboard). Alternatively, the corrugated material may be formed of a translucent plastic. In yet another embodiment, the material from which the closure is formed may be a noncurrogated material. Preferably, according to these embodiments, the closure would be rigid enough to support itself in an inverted-V configuration, as shown in FIG. 21, without the need for a framework structure. The corrugated material may be shaped similar to flexible sheet 98, shown in FIG. 12, and may be foldable to attain the configuration shown in FIG. 21. Furthermore, the corrugated material may be provided with translucent panels 300 to allow the passage of light through the closure. Alternatively, panels 300 may be opaque and/or may be removable with respect to the rest of the closure, for example, to allow access for cleaning panels, closure surfaces and stall area surfaces which would otherwise be difficult to reach. Adjustments to the width and height of the closure shown in FIG. 21 can be accomplished by narrowing or enlarging the angled formed by the top ridge crease 302. The structure shown in FIG. 21 may be supported within a stall area by the use of standard brackets, or self-sticking hooks (similar to the hooks shown in FIG. 19).

In yet another embodiment of the present invention, strips of a relatively rigid material (e.g., metal or plastic) may be laminated or otherwise attached to flexible sheeting, such as flexible sheet 16, flexible sheet 98 or flexible sheet 150. Preferably, the strips of relatively rigid material are disposed on the portions of the flexible sheet which drape around the struts 62, 64, 66, and 68, or supports 32. The strips operate as stiffeners giving additional body to the flexible sheet material where the sheet drapes over the struts or the supports. A purpose of the stiffeners is to cause the barrier to cantilever to the end wall, therefore creating a wall-to-barrier seal. This is especially beneficial when a large gap occurs between the struts or end supports and the end walls. The stiffeners may be used as a substitute for the ridge rod extenders discussed above with respect to the embodiment shown in FIG. 7.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A closure for a stall area defined by two opposing vertical walls and at least one of a shower curtain and a door structure, the closure comprising:

a sheet of flaccid foldable material which is separate and independent of the two opposing walls; and a frame structure supporting the sheet, the frame structure being supportable by the two opposing walls;

wherein the frame structure defines an inverted "V" framework for supporting the sheet in an inverted "V" configuration.

2. A closure as claimed in claim 1, wherein the sheet of foldable material comprises at least one of the materials selected from the group consisting of a thin vinyl sheet, a thin fabric sheet and a thin plastic sheet.

3. A closure as claimed in claim 1, wherein the frame structure comprises:

an inflatable chamber supportable by the two opposing walls; and flexible sheet material supported by the inflatable chamber.

4. A closure as claimed in claim 3, further comprising a plurality of hook members, each hook member being securable to one of the two opposing walls and to the inflatable chamber.

5. A closure as claimed in claim 1, wherein the stall area has a showerhead extending from one of the two opposing walls and wherein the sheet is provided with at least one of an aperture and a slit through which the showerhead extends.

6. A closure as claimed in claim 1, wherein the stall area has a showerhead extending from one of the two opposing walls, wherein the sheet is provided with a slitted portion having a slit through which the showerhead extends and wherein the closure further comprises securing means for securing the slit of the slitted portion closed around the showerhead.

7. A closure for a bathing facility stall area defined by two opposing vertical walls and at least one of a shower curtain and a door structure, the closure comprising:

a sheet of flaccid foldable material which is separate and independent of the two opposing walls; and a frame structure supporting the sheet, the frame structure being supportable by the two opposing walls;

wherein the frame structure comprises at least one extensible rod having pressing means for simultaneously pressing against the two opposing walls, and defines an inverted "V" framework for supporting the sheet in an inverted "V" configuration.

8. A closure as claimed in claim 7, wherein each extensible rod comprises two friction members, each friction member for abutting one of the two opposing walls.

9. A closure as claimed in claim 7, wherein each extensible rod comprising:

a substantially cylindrical member;

a sleeve member having a substantially hollow interior portion in which the substantially cylindrical member is inserted; and a spring arranged to urge the substantially cylindrical member out of the substantially hollow interior portion of the sleeve member.

10. A closure for a bathing facility stall area defined by two opposing vertical walls and at least one of a shower curtain and a door structure, the closure comprising:

a sheet of flaccid foldable material which is separate and independent of the two opposing walls; and a frame structure for supporting the sheet, the frame structure being supportable by the two opposing walls;

wherein the frame structure comprises:

first and second extensible rods, each extensible rod having pressing means for simultaneously pressing against the two opposing walls to thereby support the extensible rod between the two opposing walls;

a third rod; and support means, extending between the first and second extensible rods and the third rod, for supporting the third rod with the first and second extensible rods.

11. A closure as claimed in claim 10, wherein the support means comprises:

a first plurality of support rods extending between the first extensible rod and the third rod; and a second plurality of support rods extending between the second extensible rod and the third rod.

12. A closure as claimed in claim 11, wherein each support rod of said first plurality of support rods and of said second plurality of support rods comprises:

a rod member;

a first spring clip for clipping the rod member to one of the first and second extensible rods; and a second spring clip for clipping the rod member to the third rod.

13. A closure as claimed in claim 10, wherein:

the first and second extensible rods are supportable between the two opposing walls in a parallel space relationship and at substantially equal heights within the stall area;

the third rod is supportable by the support means in a substantially parallel relationship with respect to the first and second extensible rods at a height above the height of the first and second extensible rods and at substantially equal distances from the first and second extensible rods;

whereby the frame structure supports the sheet in an inverted "V" configuration.

14. A closure as claimed in claim 10, wherein the support means comprises:

first and second struts extending between the first extensible rod and the third rod; and third and fourth struts extending between the second extensible rod and the third rod.

15. A closure as claimed in claim 14, wherein:

the third rod has first and second ends, a substantially hollow interior portion adjacent each end, and an aperture at each end opening into the substantially hollow interior portion adjacent each end; and each of the first, second, third and fourth struts has an extension member insertable through the aperture at one end of the third rod and into the substantially hollow interior portion adjacent one end of the third rod.

16. A closure as claimed in claim 14, wherein each strut has a rod member and a clip for clipping the rod member to one of the extensible rods.

17. A closure as claimed in claim 16, wherein the clip of each strut comprises an S-shaped bend extending from one end of the rod member of the strut.

18. A closure for a stall area provided with two opposing walls and at least one of a shower curtain and a door structure, the closure comprising:

a sheet of foldable material; and a frame structure for supporting the sheet, the frame structure being supportable by the two opposing walls and being composed of:

first and second extensible rods, each extensible rod having pressing means for simultaneously pressing against the two opposing walls to thereby support the extensible rod between the two opposing walls;

a third rod having first and second ends, a substantially hollow interior portion adjacent each end, and an aperture at each end opening into the substantially hollow interior portion adjacent each end; and first and second struts extending between the first extensible rod and the third rod and third and fourth struts extending between the second extensible rod and the third rod, the first, second, third and fourth struts supporting the third rod with the first and second extensible rods;

each of the first, second, third and fourth struts having an extension member insertable through the aperture at one end of the third rod and into the substantially hollow interior portion adjacent one end of the third rod;

wherein the extension member of each strut comprises a U-shaped bent portion of the strut.

19. A closure in a bathing facility stall area defined by side walls and at least one of a shower curtain and a bathtub structure and a ceiling spaced from the shower curtain or bathtub structure forming an open space therebetween, the closure comprising:

a sheet of flexible material dimensioned to span at least said stall area; and a frame structure adapted to be fixed to the side walls and extending, at least partially, into the open space formed between the ceiling and the shower curtain or bathtub structure, the frame structure having a configuration supporting the sheet in an inverted V-shape.

20. In a stall area bounded by first and second opposing walls, a third wall connecting the first and second opposing walls, a ceiling and at least one of a curtain rod spaced from the ceiling and a door structure spaced from the ceiling, the improvement comprising a closure arrangeable, at least partially, in the space between the ceiling and the curtain rod or door structure, the closure comprising:

a plurality of rods, each rod extending between from the first to the second opposing walls and being supported by the first and second opposing walls; and a flexible flaccid barrier supported by the plurality of rods.

21. A stall area as claimed in claim 20, wherein the frame structure defines an inverted "V" framework for supporting the sheet in an inverted "V" configuration.

22. A closure in a bathing facility stall area defined by side walls and at least one of a shower curtain and a bathtub structure and a ceiling spaced from the shower curtain or bathtub structure forming an open space therebetween, the closure comprising:

a generally inverted V-shaped member comprising a sheet of flexible material having dimensions to span at least the entire stall area and means of affixing said closure in said stall area to extend, at least partially, into the open space formed between the ceiling and the shower curtain or bathtub structure of the bathing facility stall area.

23. A closure as claimed in claim 22, wherein the inverted V-shaped member includes at least one removable panel.

24. A closure as claimed in claim 22, wherein the generally V-shaped member is composed of a corrugated material.

25. A closure for a stall area of at least one of a shower and a bath, the stall area defined by two opposing substantially rigid and substantially planar walls and at least one of a shower curtain and a door structure, the closure comprising:

a sheet of flaccid foldable material which is separate and independent of the two opposing walls; and a frame structure supporting the sheet of foldable material in an upper region of the stall area, the frame structure being supported by the two opposing walls;

wherein the frame structure comprises a plurality of rods, each rod extending from one to the other opposing wall and being supported by the two opposing walls.

26. A closure as claimed in claim 25, wherein the stall area is further provided with a bathtub, and wherein the frame structure supports the sheet of foldable material above the bathtub.

* * * * *